United States Patent [19]

So et al.

[11] Patent Number: 4,963,250

[45] Date of Patent: Oct. 16, 1990

[54] KEROGEN AGGLOMERATION PROCESS FOR OIL SHALE BENEFICIATION USING ORGANIC LIQUID IN PRECOMMUNICATION STEP

[75] Inventors: Bernard Y. C. So, Wheaton; Terry L. Marker, Lisle, both of Ill.

[73] Assignee: Amoco Corporation, Chicago, Ill.

[21] Appl. No.: 434,707

[22] Filed: Nov. 9, 1989

[51] Int. Cl.[5] ..... C10G 1/00

[52] U.S. Cl. ..... 208/426; 241/15/20; 208/430

[58] Field of Search ..... 208/426; 241/20, 15

[56] References Cited

U.S. PATENT DOCUMENTS

| | | | |
|---|---|---|---|
| 3,448,931 | 6/1969 | Myatt | 241/20 |
| 3,665,066 | 5/1972 | Capes et al. | 208/426 |
| 4,057,486 | 11/1977 | Meadus et al. | 208/426 |
| 4,153,419 | 5/1979 | Clayfield et al. | 44/23 |
| 4,158,638 | 6/1979 | Tsai | 208/426 |
| 4,176,042 | 11/1979 | Fahlstrom | 208/426 |
| 4,209,301 | 6/1980 | Nicol et al. | 44/24 |
| 4,288,166 | 9/1981 | Nakabayashi | 241/15 |
| 4,396,396 | 8/1983 | Mainwaring | 241/21 |
| 4,484,928 | 11/1984 | Keller, Jr. | 241/20 |
| 4,506,835 | 3/1985 | Tsai | 241/20 |
| 4,528,090 | 7/1985 | Tsui | 241/20 |
| 4,576,708 | 3/1986 | Oko et al. | 208/426 |
| 4,587,006 | 5/1986 | Minden | 208/426 |
| 4,643,361 | 2/1987 | Chapman | 241/20 |
| 4,667,885 | 5/1987 | Datta | 241/20 |
| 4,668,380 | 5/1987 | Wolff et al. | 208/430 |
| 4,726,810 | 2/1988 | Ignasiak | 44/51 |
| 4,730,787 | 3/1988 | Trass | 241/15 |

FOREIGN PATENT DOCUMENTS

| | | | |
|---|---|---|---|
| 2950701 | 6/1981 | Fed. Rep. of Germany | 108/426 |
| 2037809 | 7/1980 | United Kingdom | 208/426 |

OTHER PUBLICATIONS

Reisberg, J., Beneficiation of Green River Oil Shale by Pelletization, 1981, American Chemical Society, V. 163, pp. 145–166.

*Primary Examiner*—Helane K. Meyers

*Attorney, Agent, or Firm*—Reginald K. Taylor; William H. Magidson; Ralph C. Medhurst

[57] ABSTRACT

In a kerogen agglomeration process, the oil shale is pretreated by comminuting the oil shale in the presence of an added organic liquid prior to contacting the oil shale with an added organic liquid and water to form kerogen-rich agglomerates and mineral-rich particles. The benefit is a reduction in comminution cost while maintaining about the same separation efficiency as methods having higher comminution costs.

24 Claims, No Drawings

KEROGEN AGGLOMERATION PROCESS FOR OIL SHALE BENEFICIATION USING ORGANIC LIQUID IN PRECOMMUNICATION STEP

FIELD OF THE INVENTION

The present invention is a method of beneficiating shale to reduce kerogen processing costs. More specifically, the present invention comminutes the oil shale in the presence of an organic liquid prior to kerogen agglomeration.

BACKGROUND OF THE INVENTION

In view of the recent instability of the price of crude oil and natural gas, there has been renewed interest in alternate sources of energy and hydrocarbons. Much of this interest has been centered on recovering hydrocarbons from solid hydrocarbon material such as oil shale, coal, and tar sands by pyrolysis or upon gasification to convert the solid hydrocarbon-containing material into more readily usable gaseous and liquid hydrocarbons.

Vast reserves of hydrocarbons in the form of oil shales exist throughout the United States. The Green River formation of Colorado, Utah, and Wyoming is a particularly rich deposit and includes an area in excess of 16,000 square miles. It has been estimated that an equivalent of 7 trillion barrels of oil are contained in oil shale deposits in the United States, almost sixty percent located in the Green River oil shale deposits. The remainder is largely contained in the leaner Devonian-Mississippi black shale deposits which underlie most of the eastern part of the United States.

Oil shales are sedimentary inorganic materials that contain appreciable organic material in the form of high molecular weight polymers. The inorganic part of the oil shale is marlstone-type sedimentary rock. Most of the organic material is present as kerogen, a solid, high molecular weight, three-dimensional polymer which has limited solubility in ordinary solvents and therefore cannot be readily recovered by simple extraction.

A typical Green River oil shale is comprised of approximately 85 weight percent mineral components, of which carbonates are the predominate species. Lesser amounts of feldspars, quartz, and clays are also present. The kerogen component represents essentially all of the organic material. A typical elemental analysis of Green River oil shale kerogen is approximately 78 weight percent carbon, 10 weight percent hydrogen, 2 weight percent nitrogen, 1 weight percent sulfur, and 9 weight percent oxygen.

Most of the methods for recovering kerogen from oil shale involve mining the oil shale, crushing it, and thermally decomposing (retorting) the crushed oil shale. In view of the fact that approximately 85 weight percent of the oil shale is mineral components, unless something is done to remove these minerals, most of the oil shale which is fed, heated up, and circulated in a retort is composed of material that cannot produce oil. This high percentage of inorganic material significantly interferes with subsequent shale processing to recover the kerogen. For example, in retorting the shale, either large or numerous retorts are needed to process the commercial quantities involved. Moreover, a substantial amount of heat is expended and lost in heating up the inorganic minerals to retorting temperatures and cooling them back down again.

Another problem associated with the large amount of inorganic mineral matter is pollution. In the retorting process, contaminating fines are produced and must be disposed of. The greater the quantity of minerals, the greater the quantity of fines. Another source of pollution is the spent shale recovered from the retort. During retorting, chemical reactions occur in the shale as the kerogen is volatized. This results in a residue of chemical compounds in the spent shale leaving the retort. These compounds can present a hazard in surface water pollution after they have been discarded.

As a result of these problems, it can be economically beneficial to remove the minerals prior to retorting. This is called "shale beneficiation." Beneficiation is basically divided into the two steps of liberating the kerogen and separating the kerogen from the mineral matter. An essential part of the first step is comminuting the oil shale. Suitable equipment for comminuting the oil shale includes hazemag mills, semi-autogenous (SAG) mills, ball mills, and tower mills. The number of comminuting stages and the selection of the most efficient mill depends upon the intrinsic grain size of the kerogen and the extent of kerogen liberation required.

In a SAG mill, which is a cascade mill in which about 10 volume percent steel balls supplement the solid oil shale feed as comminution media, the shale can be ground down to about ½ in. top size. A ball mill, which is a tumbling mill using about 50 volume percent steel balls as comminution media, can grind the shale down to about 0.003 in. top size. To obtain a top size of less than 0.003 in., a tower mill can be used. The tower mill is a stirred ball mill that uses attrition as the mechanism for size reduction.

After comminuting the shale to produce kerogen-rich particles and mineral-rich particles, the second step of beneficiation is separating these particles. This separation can occur by chemical or physical separation.

Chemical separation includes leaching of minerals, such as acid leaching of carbonates, or extraction of kerogen by chemically breaking the kerogen bonds. U.S. Pat. Nos. 4,176,042 and 4,668,380 are examples of chemical beneficiation of oil shale.

An example of physical separation is density separation. This type of physical separation is possible because kerogen has a specific gravity of about 1 gm/cm$^3$ and because mineral components in oil shale have a density of about 2.8 gm/cm$^3$. Heavy media cyclone is a process for separating, by density, relatively coarse oil shale particles. An example of a heavy media separation process is disclosed in U.S. Pat. No. 4,528,090. In general, the aim of heavy media separation is to separate shale into a kerogen-rich fraction having low density and a kerogen-lean fraction having high density. The liquid medium used is a mixture of water and finely ground magnetite and ferrosilicon. By varying the concentration of the magnetite and ferrosilicon, the medium can be made to have a density from 1.8–2.4 gm/cm$^3$ so that the shale can be split at the density required. The kerogen-rich material floats to the top and is taken overhead, and the kerogen-lean material goes into the underflow from the cyclone. The disadvantages of this process are that it relies upon an inherent natural heterogeneity among oil shale particles and that it has not been successful in separating small oil shale particles.

Surface property separation is another form of physical separation. An example of surface property separation is froth flotation. In this process, oil shale particles are mixed with an aerated aqueous solution. Since the kerogen-rich particles have greater hydrophobic character than mineral-rich particles, the kerogen-rich particles preferably attach to the air bubbles, thereby causing the kerogen-rich particles to float. Subsequently, the froth containing these kerogen-rich particles is removed. Additives can be used to improve kerogen grade and recovery. One disadvantage of the froth flotation process is the oil shale must be comminuted to a fine particle size prior to froth flotation. Another disadvantage of this process is that the effects of different types of collectors, frothers, and dispersants are difficult to predict. In addition, floated, kerogen-enriched shale has a tendency to have a higher concentration of carbonates than starting shale. This increase in carbonate concentration can lower the separation efficiency. An example of a froth flotation process is disclosed in U.S. Pat. No. 4,673,133.

Another example of surface property separation is selective agglomeration. Selective agglomeration is the combination or aggregation of specific particles into clusters of approximately spherical shape. The selective agglomeration of coal fines is known in the art. U.S. Pat. Nos. 4,209,301 and 4,153,419 disclose methods of selectively agglomerating bituminous high-rank coal fines utilizing high-quality oils. U.S. Pat. No. 4,726,810 discloses a process for selectively agglomerating low-rank, sub-bituminous coals using a low-quality oil. The difference between the methods disclosed in these patents and the instant invention is that the instant invention selectivity agglomerates oil shale rather than coal. Because of the difference in chemistry of oil shale and coal, the methods of selective agglomeration must be different. Coal is typically precomminuted in water; however, precomminuting oil shale in water will interfere with the selective agglomeration of the kerogen.

In the selective agglomeration of oil shales, one can agglomerate the kerogen-rich particles or the mineral-rich particles. U.S. Pat. No. 4,057,486 discloses a method of agglomerating the mineral-rich particles. In this method, the mineral solids are first finely divided by pulverizing or grinding the oil shale. Next, the hydrocarbons in the oil shale are dispersed by contacting the ground oil shale with an organic solvent, thereby forming a liquid slurry. The slurry is then contacted with an aqueous agglomerating liquid, thereby forming a multiphase mixture. The multiphase mixture is agitated for a time sufficient to form discrete mineral agglomerates substantially free of hydrocarbon. The mineral agglomerates are then separated from the hydrocarbon phase by decanting or screening. This method of separating hydrocarbons from minerals differs from the instant invention in that the instant invention is a process of forming kerogen-rich agglomerates rather than inorganic mineral agglomerates.

In Reisberg, J., "Beneficiation of Green River Shale by Pelletization," *American Chemical Society* (ASCMC8), V. 163 (Oil Shale, Tar Sands, and Related Materials), pp. 165–166, 1981, ISSN 00976156, a process that agglomerates the kerogen-rich particles is disclosed. The process wherein kerogen-rich particles are agglomerated is known as kerogen agglomeration. In kerogen agglomeration, oil shale particles are contacted with an organic liquid and water to form agglomerates of the kerogen-rich particles while the mineral-rich particles disperse into a water phase. The Reisberg reference describes dry precomminuting the shale to a size small enough to pass through a 0.0059 in. (100 mesh) screen, and subsequently comminuting the pulverized shale in the presence of heptane and water to form a kerogen-enriched fraction in the form of discrete pellets and a mineral-rich fraction dispersed in an aqueous phase. There the pellets are separated from the aqueous phase using sieves. The comminution cost associated with the initial comminution of the shale is prohibitively high and requires an excessive power outlay. An estimated total comminution power input for the process is 130 Kw-hr/ton of shale.

There is a need for a commercially viable kerogen agglomeration process. More specifically, there is a need for an kerogen agglomeration process with reduced comminution costs.

SUMMARY OF THE INVENTION

In its broadest aspect, the present invention is a kerogen agglomeration method for beneficiating oil shale. In the first step, a substantial portion of the oil shale is comminuted to a top size of about 0.4–0.003 in. in the presence of an added organic liquid. In the next step, the oil shale is contacted with a multiphase liquid comprising an added organic liquid and water to form kerogen-rich agglomerates and mineral-rich particles. Finally, the kerogen-rich agglomerates are separated from the mineral-rich particles. Wet comminuting in an organic liquid prior to kerogen agglomeration is more power efficient than dry comminuting or wet comminuting in water (followed by drying) prior to kerogen agglomeration.

In one embodiment, the present invention is a kerogen agglomeration method for beneficiating raw oil shale. The method includes comminuting a substantial portion of the oil shale to a top size of about 1/8–0.003 in. in the presence of an added hydrocarbon liquid. After comminution, excess hydrocarbon liquid is removed from the oil shale. Next the oil shale is comminuted with a two-phase liquid consisting essentially of an added hydrocarbon liquid and water to form kerogen-rich agglomerates and mineral-rich particles. Finally, the kerogen-rich agglomerates are separated from the mineral-rich particles with at least one screen. The screen should have a size such that the screen prevents the passage of the kerogen-rich agglomerates while the screen allows the passage of the mineral-rich particles dispersed in the water phase. The size of the kerogen-rich agglomerates is greater than the size of the mineral-rich particles.

In another embodiment, a substantial portion of the oil shale is comminuted to top size of about 1/16–0.003 in. in the presence of added shale oil utilizing at least one ball mill arranged in a closed loop system. The shale oil to oil shale ratio ranges from 0.4 to 2.4. Then the oil shale is treated to remove excess shale oil. This is followed by comminuting the oil shale using at least one ball mill arranged in an open loop system in an added shale oil and water mixture to form kerogen-rich agglomerates and mineral-rich particles dispersed in water. The shale oil to oil shale ratio is 0.1 to 1. The shale oil to water ratio is 0.3 to 1.3. The power input for comminution during this step is 1–50 Kw-hr/ton of shale. The final step is to separate the kerogen-rich agglomerates from the mineral-rich particles utilizing at least one screen having a screen size from about 0.0117–0.0015 in.

DESCRIPTION OF THE PREFERRED EMBODIMENT

The starting material for the present invention is raw oil shale which has been mined using conventional techniques. A shale suitable for use in this invention can be characterized as having the following make up: about 6–30 weight percent kerogen, about 40–50 weight percent silicates and clays, about 22 to 42 weight percent carbonates, about 0–10 weight percent dawsonites, and about 0–12 weight percent nacholites. Mineralogy can have an effect on kerogen agglomeration. For example, shales abundant in silicates, zeolites, clays and dawsonites are generally easier to beneficiate by kerogen agglomeration than shales with an abundance of siderite, pyrite, ankerite, dolomite, and calcite. A shale grade suitable for use in this invention ranges from about 6–30 weight percent kerogen. Shale grade can also have an effect on kerogen agglomeration. For example, in Mahogany shale, percent mineral rejection and percent product improvement decrease with increasing shale grade for a given mineral composition. Percent mineral rejection is defined as the difference between the weight of minerals in the feed and the weight of minerals in the product divided by the weight of minerals in the feed (X 100). Percent product improvement is defined as the difference between the product grade and the feed grade divided by the feed grade (X 100).

Comminuting the oil shale prior to kerogen agglomeration, i.e., precomminuting the oil shale, in the presence of an organic liquid is an essential part of the present invention. The term "comminuting" is defined as reducing the size of an oil shale particle. The organic liquid is not intended to be kerogen liberated from the oil shale itself, but rather is intended to be an organic liquid in addition to such kerogen. Organic liquid can be defined as a hydrocarbon liquid with a boiling point ranging from about 150–1300 deg. F., preferably from about 150–500 deg. F. Examples of such liquids include shale oils and petroleum fractions. In the event that the organic liquid is shale oil, the shale oil can be a derivative of oil shale previously beneficiated using the present invention. An organic liquid to oil shale ratio suitable for use in this invention ranges from about 0.4 to about 2.4, preferably from about 0.4 to 1.0. Equipment suitable for use in comminuting the shale includes ball mills, tower mills, vibratory mills, and stirred ball mills. The preferred mill is a ball mill. A ball charge suitable for use in the ball mill ranges from about 35–65 percent by volume. The exact size of the mill will depend upon the desired throughput. The comminution scheme can be closed loop or open loop, preferably closed loop. The power required to comminute the oil shale in the presence of an organic liquid is less than that required to comminute the shale in a dry environment. Comminuting in water is undesirable since it will interfere with the subsequent kerogen agglomeration step. A substantial portion of the oil shale exiting this precomminution step have a top size ranging from about 0.4–0–0.003 in., preferably from about 1/8–0.003 in., more preferably from about 1/16–0.003 in. A suitable temperature range for the precomminution step can be ambient to about 400 deg. F.

After the shale is comminuted in the presence of an organic liquid, the shale is filtered to remove any excess organic liquid prior to kerogen agglomeration. If the shale entering the kerogen agglomeration step contains too much organic liquid, unstable agglomerates are likely to be formed, thereby reducing the efficiency of separation of the kerogen-rich agglomerate from the mineral matter. Means for filtering the organic liquid-saturated oil shale include a continuous vacuum filter and a filter press.

Kerogen agglomeration is the next step. Kerogen agglomeration is based on the difference in surface properties between kerogen and minerals. In the present invention, oil shale particles saturated with organic liquid are contacted with water. Kerogen-rich particles tend to agglomerate into spherically-shaped clusters. Mineral-rich particles do not agglomerate but tend to form a dispersion in the aqueous phase.

In the kerogen agglomeration step of the present invention, the oil shale particles are contacted with an added organic liquid and water to form kerogen-rich agglomerates and mineral-rich particles. The term "contacted" is defined as coming together and touching, comminuting, or any combination thereof. In a preferred embodiment, the kerogen agglomeration step includes comminuting the oil shale particles in an added organic liquid and water. A process wherein the oil shale is comminuted in an organic liquid and water results in a more effective separation of kerogen and minerals particles than a process wherein the oil shale is merely brought together (no appreciable reduction in the oil shale particle size) with an organic liquid and water. Comminution can be accomplished with a ball mill or a stirred ball mill. The comminution scheme can be open or closed, preferably open. The power input required to properly comminute the shale during kerogen agglomeration ranges from about 1–50 Kw-hr/ton, preferably from about 1–25 Kw-hr/ton. The organic liquid can be defined as a hydrocarbon liquid with a boiling point from about 150–1300 deg. F., preferably from about 150–500 deg. F. The water can be fresh water or salt water. A suitable organic liquid to shale ratio for the present invention can be about 0.1 to 1.0. A suitable organic liquid to water ratio can be about 0.3 to 1.3, preferably about 0.44. A suitable amount of oil shale solids in the kerogen agglomeration step of the present invention can be about 25 to 75 weight percent, preferably about 53 percent. A suitable minimum agglomerate size for the present invention can be about 0.0117 in. (48 mesh) to 0.0015 in. (400 mesh). A suitable temperature range for the kerogen agglomeration step can be ambient to about 200 deg. F.

If too much organic liquid is left in the shale, unstable agglomerates can be formed resulting in poor separation of the kerogen-rich particles and the mineral-rich particles. Poor separation can also result from adding too little water because there would not be enough medium for rejecting the fines. Too little organic liquid left in the shale can result in not enough agglomerates being formed. Too much water can result in comminution inefficiencies.

After kerogen agglomeration, the kerogen-rich agglomerates and the mineral-rich particles are separated. The size of the kerogen-rich agglomerates is greater than the size of the mineral-rich particles. Means suitable for use in separating out these agglomerates include screens, cyclones, and floatation equipment. The use of a screen is preferred. The screen should have size small enough to prevent passage of the kerogen-rich agglomerates, but large enough to allow passage of the mineral-rich particles which are dispersed in the water phase. Screen sizes suitable for use in this separation range from 0.0117 in. (48 mesh) to 0.0015 in. (400 mesh).

EXAMPLE 1

The purpose of this example was to evaluate the costs associated with dry comminuting oil shale prior to kerogen agglomeration. More specifically, the purpose of this example was to evaluate the power input requirements and separation efficiency of dry comminuting prior to kerogen agglomeration of the oil shale. Separation efficiency was defined as the difference between the recovery of organics in the product stream and the recovery of inorganics in the product stream.

The comminution equipment used in this example consisted of an 8 in.×10 in. long steel jar mill. It was operated at 71.3 RPM 76.0 percent theoretical critical speed (T.C.S.) for a 120 min time duration. The comminution media was 1 in. diameter steel balls.

The feed material was 22 gal/ton oil shale. The shale was essentially 99 percent minus 0.047 in. (14 mesh), with approximately 15 percent minus 0.0083 in. (65 mesh). The feed 80 percent passing point corresponded to approximately 0.035 in.

In the first stage, 1952 g of the feed material were mixed with 35 lbs of the comminution media and comminuted in the jar mill for 120 min. The product from this first stage of milling was 80 percent minus 0.003 in.

In the second stage, 1000 g of the product from the first stage were blended with 500 g of octane to form a thick, mud-like consistency material. This mixture and 2000 g of water were charged into the jar mill and run for 60 min.

The organics formed into black nodules which were separated, weighed, and dried. The separation efficiency was 41. The total comminution power consumption was 73 Kw-hr/ton, 37 Kw-hr/ton in the first stage and 36 Kw-hr/ton in the second stage. A summary of the results of Example 1 can be found in Table 1.

EXAMPLE 2

The purpose of this example was to evaluate the cost associated with wet comminuting oil shale in the presence of an organic liquid prior to kerogen agglomeration. More specifically, this example was designed to focus on the separation efficiency and power input requirements associated with wet comminuting oil shale in the presence of an organic solvent prior to kerogen agglomeration.

The comminution equipment used in this example was the same as the comminution equipment used in Example 1.

The feed material was a blend of oil shales having a grade of 22 gal/ton. The shale was essentially 97 percent minus 0.0467 in. (14 mesh), with only approximately 30 percent minus 0.0083 in. (65 mesh). The feed 80 percent passing point corresponded to approximately 0.035 in.

In the first stage, 1952 g of this feed material were mixed with 35 lbs of the comminution media and 1952 ml of octane, and comminuted for 60 min.

In the second stage, 1000 g of the ground shale from stage one were filtered to remove excess octane. This material containing approximately 500 ml of absorbed octane was charged with 2000 g of water into a jar mill and run for 60 min.

The organic formed into black nodules which were separated, weighed, and dried. The separation efficiency was 40. The total comminution power input was 55 Kw-hr/ton, 19 Kw-hr/ton in the first stage and 36 Kw-hr/ton in the second stage. A summary of the results of Example 2 can be found in Table 1.

A comparison of the data presented in Examples 1 and 2 show that wet comminuting oil shale in an organic liquid prior to kerogen agglomeration required less power input than dry comminuting oil shale prior to kerogen agglomeration at about the same separation efficiency.

EXAMPLE 3

The purpose of this example was to evaluate the costs associated with wet comminutinq oil shale in the presence of water prior to kerogen agglomeration of the oil shale.

The comminution equipment and the feed material used in this example were the same as that used in Example 2.

In the first stage, 1952 g of this feed material were mixed with 35 lbs of comminution media and 1952 g of water and comminuted for 60 min.

In the second stage, the shale was completely dried in an oven. This is significant because it requires additional power and equipment to dry the water out of the oil shale. Then 1000 g of the dried shale were blended with 500 ml of octane to form a thick, mud-like consistency. This material and 2000 g of water were charged into the jar mill and run for 60 min.

The organics formed into black nodules which were separated, weighed, and dried. The separation efficiency was 28. The comminution total power input was 55 Kw-hr/ton, 19 in the first stage and 36 in the second stage. A summary of the results of Example 3 can be found in Table 1.

A comparison of the data in Examples 2 and 3 illustrates that, at the same comminution power input, there is a higher separation efficiency for oil shales that were comminuted in an organic liquid prior to kerogen agglomeration than for oil shales that were comminuted in water prior to kerogen agglomeration. Comminution in water also requires additional power to dry the water out of the shale before kerogen agglomaeration. This is also economically undesirable.

TABLE 1

| Example # | 1 | 2 | 3 |
|---|---|---|---|
| Feed Shale (GPT) | 22.5 | 22.6 | 22.4 |
| Separation Efficiency | 41 | 40 | 28 |
| Total Comminution Power (Kw-hr/ton) | 73 | 55 | 55 |
| Comminution Time (1st Stage) | 120 | 60 | 60 |
| Water Present (Yes or No) | No | No | Yes |
| Organic Liquid present (Yes or No) | No | Yes | No |
| Evaportion of Water Before Aggl. (Yes or No) | No | No | Yes |
| Kerogen Agglomeration Time (2nd Stage) | 60 | 60 | 60 |
| Product Grade (GPT) | 40.4 | 37.2 | 38.3 |
| % Organic Recovery in Product | 83 | 89 | 57 |
| Reject Grade (GPT) | 4.4 | 3.6 | 13.4 |
| Wt % Organic-Rich Fraction | 47 | 55 | 33 |
| Wt % Inorganic-Rich Fraction | 53 | 45 | 67 |

What is claimed is:

1. A kerogen agglomeration method for beneficiating oil shale, comprising the steps of:

(a) comminuting a substantial portion of the oil shale to a top size of about 0.4–0.003 inch in the presence of an added liquid consisting essentially of an organic liquid;

(b) contacting said oil shale with a multiphase liquid comprising an added organic liquid and water to form kerogen-rich agglomerates and mineral-rich particles; and (c) separating the kerogen-rich agglomerates from the mineral-rich particles.

2. A method of claim 1 wherein the oil shale comprises raw oil shale.

3. A method of claim 1 wherein in step (a) the oil shale is comminuted with at least one ball mill.

4. A method of claim 3 wherein the ball mill is arranged in a closed loop system.

5. A method of claim 1 wherein the organic liquid comprises a hydrocarbon liquid having a boiling point from about 150 to 1300 deg. F.

6. A method of claim 5 wherein the hydrocarbon liquid comprises a petroleum fraction.

7. A method of claim 5 wherein the hydrocarbon liquid comprises shale oil.

8. A method of claim 1 wherein in step (a) there is an organic liquid to shale ratio of about 0.4–2.4.

9. A method of claim 1 wherein in step (b) there is an organic liquid to shale ratio of about 0.1–1.

10. A method of claim 1 wherein in step (b) there is an organic liquid to water ratio of about 0.3–1.3.

11. A method of claim 1 wherein in step (b) there is an power input of 1–50 Kw-hr/ton of shale.

12. A method of claim 1 wherein in step (c) at least one screen is used to separate the kerogen-rich agglomerates from the mineral-rich particles.

13. A kerogen agglomeration method for beneficiating raw oil shale, comprising the steps of:

(a) comminuting a substantial portion of the oil shale to a top size of about 1/8–0.003 inch in the presence of an added liquid consisting essentially of a hydrocarbon liquid;

(b) removing excess hydrocarbon liquid from the oil shale;

(c) comminuting the oil shale from step (b) in the presence of a two phase liquid consisting essentially of an added hydrocarbon liquid and water to form kerogen-rich agglomerates and mineral-rich particles; and (d) separating the kerogen-rich agglomerates from the mineral-rich particles using at least one screen, said screen having a size that prevents passage of the kerogen-rich agglomerates but allows passage of the mineral-rich particles dispersed in a water phase.

14. A method of claim 13 wherein in step (a) the comminution is implemented with at least one ball mill.

15. A method of claim 14 wherein the ball mill is arranged in a closed loop system.

16. A method of claim 13 wherein the hydrocarbon liquid has a boiling point from about 150 to 1300 deg F.

17. A method of claim 16 wherein the hydrocarbon liquid comprises a petroleum fraction.

18. A method of claim 16 wherein the hydrocarbon liquid comprises a shale oil.

19. A method of claim 13 wherein in step (a) there is a hydrocarbon liquid to shale ratio of about 0.4–2.4.

20. A method of claim 13 wherein in step (c) there is a hydrocarbon liquid to shale ratio of about 0.1–1.

21. A method of claim 13 wherein in step (c) there is a hydrocarbon liquid to water ratio of about 0.3–1.3.

22. A method of claim 13 wherein in step (c) there is an power input of about 1–50 Kw-hr/ton of shale.

23. A method of claim 13 wherein in step (d) the screen has a size of about 0.0117–0.0015 inch.

24. A kerogen agglomeration method for beneficiating raw oil shale, comprising the steps of:

(a) comminuting a substantial portion of oil shale to a top size of about 1/16–0.003 inch in an added hydrocarbon liquid consisting essentially of shale oil using at least one ball mill arranged in a closed loop system, said shale oil being present at a shale oil to oil shale ratio of about 0.4–2.4;

(b) removing excess shale oil from the oil shale;

(c) comminuting the oil shale from step (b) using at least one ball mill arranged in an open loop system at a power input of about 1–50 Kw-hr/ton of shale in an added shale oil and water to form kerogen-rich agglomerates and mineral-rich particles, the shale oil being present at a shale oil to oil shale ratio of about 0.1–1.0, the water being present at a shale oil to water ratio of about 0.3–1.3; and (d) separating the kerogen-rich agglomerates from the mineral-rich particles utilizing at least one screen having a screen size of about 0.0117–0.0015 inch.

* * * * *